US005596784A

United States Patent [19]

Tolmachoff

[11] Patent Number: 5,596,784

[45] Date of Patent: Jan. 28, 1997

[54] VEHICLE FOR COLLECTING DEBRIS FROM A ROAD

[76] Inventor: David Tolmachoff, 10145 W. Rose La., Glendale, Ariz. 85037

[21] Appl. No.: 532,475

[22] Filed: Sep. 22, 1995

[51] Int. Cl.[6] ..... E01H 1/04

[52] U.S. Cl. ..... 15/83; 15/84; 414/502

[58] Field of Search ..... 15/3, 53.3, 340.1, 15/84, 83; 414/437, 501, 502; 198/836.1, 836.3

[56] References Cited

U.S. PATENT DOCUMENTS

| | | | |
|---|---|---|---|
| 671,280 | 4/1901 | Jene | 15/84 |
| 876,727 | 1/1908 | Pevey | 15/84 |
| 947,963 | 1/1910 | Cable | 15/84 |
| 1,922,338 | 8/1933 | Weaver et al. | 15/84 |
| 2,896,246 | 7/1959 | Wildt | 15/405 |
| 3,203,022 | 8/1965 | Clarke | 15/340 |
| 3,300,807 | 1/1967 | Berkowitz | 15/340 |
| 3,710,412 | 1/1973 | Hollowell | 15/340 |
| 3,778,865 | 12/1973 | Schmidt, Jr. et al. | 15/340 |
| 3,802,022 | 4/1974 | Fleming | 15/84 |
| 3,881,215 | 5/1975 | Krier et al. | 15/340 |
| 3,927,780 | 12/1975 | Dearlove | 414/502 |
| 3,944,098 | 3/1976 | Foote | 414/502 |
| 4,109,336 | 8/1978 | Ford | 15/3 |
| 4,290,820 | 9/1981 | Swisher et al. | 15/84 |
| 5,142,732 | 9/1992 | Davis | 15/352 |

FOREIGN PATENT DOCUMENTS

| | | | |
|---|---|---|---|
| 1534143 | 7/1969 | Germany | 15/84 |

*Primary Examiner*—David Scherbel
*Assistant Examiner*—Tony G. Soohoo
*Attorney, Agent, or Firm*—Meschkow & Gresham

[57] ABSTRACT

A vehicle for collecting debris from a road includes an operator cab located at a front section of the vehicle, a boom assembly located at the front section, a paddle guide assembly located at the front section, and a collection bin located at a back section of the vehicle. The boom assembly carries a rotary rake, a leader blade, and a conveyor belt assembly. The operator cab and boom assembly are configured such that an operator has a substantially unobstructed view of the debris as it is being collected. The paddle guide assembly includes a plurality of paddles configured to move the debris into the path of the rotary rake. The rotary rake guides the debris over the leader blade and onto the conveyor belt assembly. The conveyor belt assembly transports the debris into the collection bin.

23 Claims, 3 Drawing Sheets

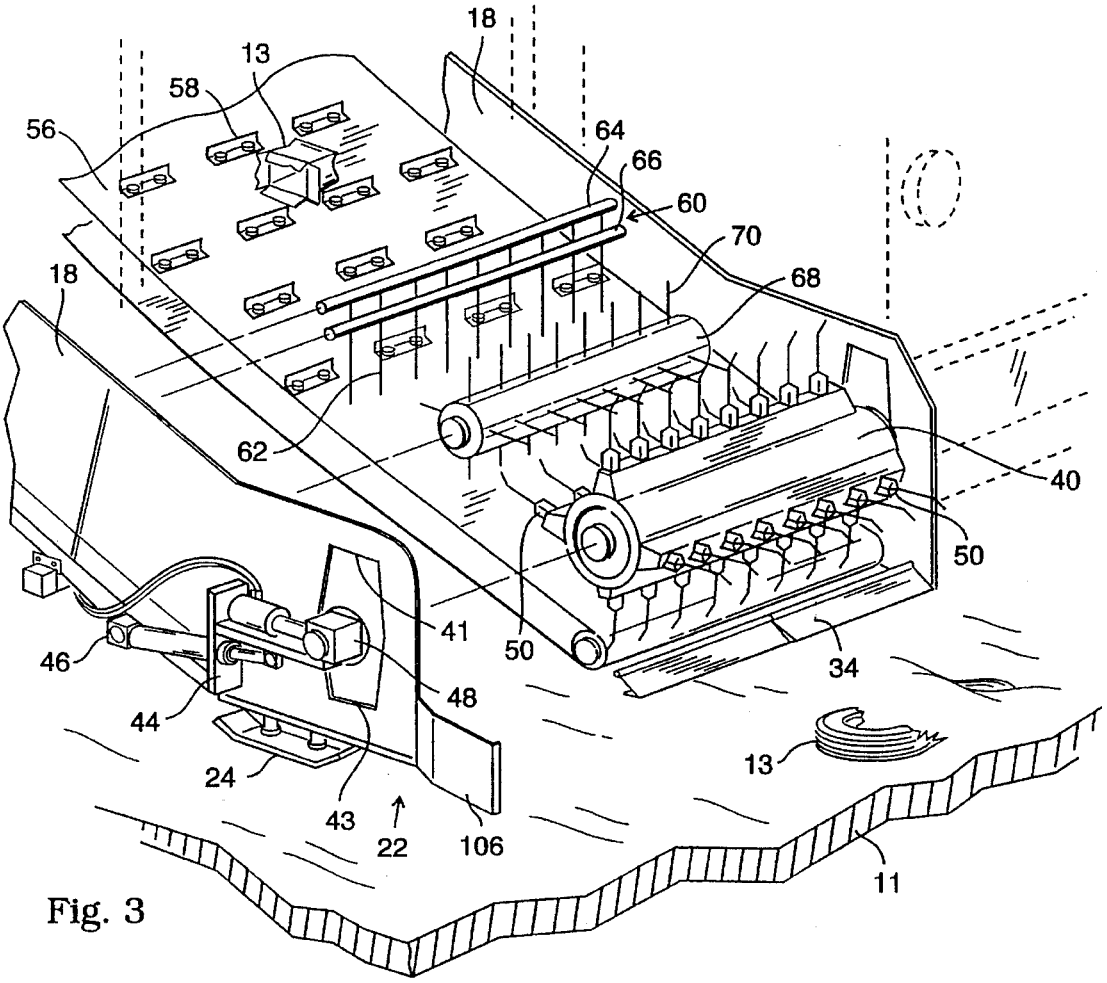
Fig. 3
Fig. 4
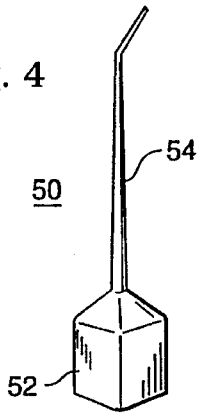

VEHICLE FOR COLLECTING DEBRIS FROM A ROAD

FIELD OF THE INVENTION

The present invention relates generally to roadway maintenance vehicles. More specifically, the present invention relates to vehicles that remove debris from the surface of a road.

BACKGROUND OF THE INVENTION

Roadway litter and debris can be unsightly and a nuisance to many drivers. Large or heavy objects on a road, such as rocks, tires, and the like, can cause accidents and traffic congestion. To alleviate the problems associated with road debris, a number of vehicles and apparatus for cleaning roads and highways have been developed.

Many conventional road cleaning vehicles utilize a vacuum mechanism to collect litter from a road surface. Such road cleaners are typically designed to remove small or lightweight objects from a road. Other vehicles may employ a brush or rake element, either alone or in combination with a vacuum mechanism, to collect larger debris from a road. For example, common street sweepers scrub the road and the curb while collecting leaves, branches, and small pieces of litter. Although such vehicles may be adequate for their intended uses, they cannot collect large or heavy objects from a road. Thus, items such as tires, hubcaps, bottles, or rocks may be left behind by many road cleaning vehicles.

Some debris-collecting vehicles are configured such that the vehicle must drive over the debris before it is collected. The driver of such a vehicle may not be able to immediately determine whether or not the vehicle successfully collected a particular object. If the vehicle fails to collect an object, then it may be necessary to repeat the process by driving over the object a second time. Alternatively, the driver may have to exit the vehicle to manually collect the debris. Unfortunately, it may be unsafe or impractical for the driver to make a second pass or exit the vehicle if traffic is flowing on the road.

Variations in the road surface condition and/or the environment surrounding the road can cause problems for some debris collecting vehicles. For example, undulations across the road may cause some equipment to accidentally drive over an object without collecting it. Other vehicles may not perform adequately if the debris is located against a curb or a retaining structure.

SUMMARY OF THE INVENTION

Accordingly, it is an advantage of the present invention that an improved vehicle for removing debris from a road is provided.

Another advantage of the present invention is that it provides a vehicle capable of removing large or heavy objects from a road.

A further advantage of the present invention is that a debris-collecting vehicle is provided that is configured to give a driver an unobstructed view of the debris while it is collected.

Another advantage is that a vehicle is provided that is capable of removing debris from a road having surface variations across the width of the road.

Another advantage of the present invention is that it provides a debris-collecting vehicle capable of removing debris located against a curb or a retaining structure on a road.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

FIG. 3 is an exploded perspective view of a boom assembly according to the present invention;

FIG. 4 is a perspective view of a flexibly-mounted tine;

DETAILED DESCRIPTION OF THE PREFERRED EMBODIMENT

Figure 1:
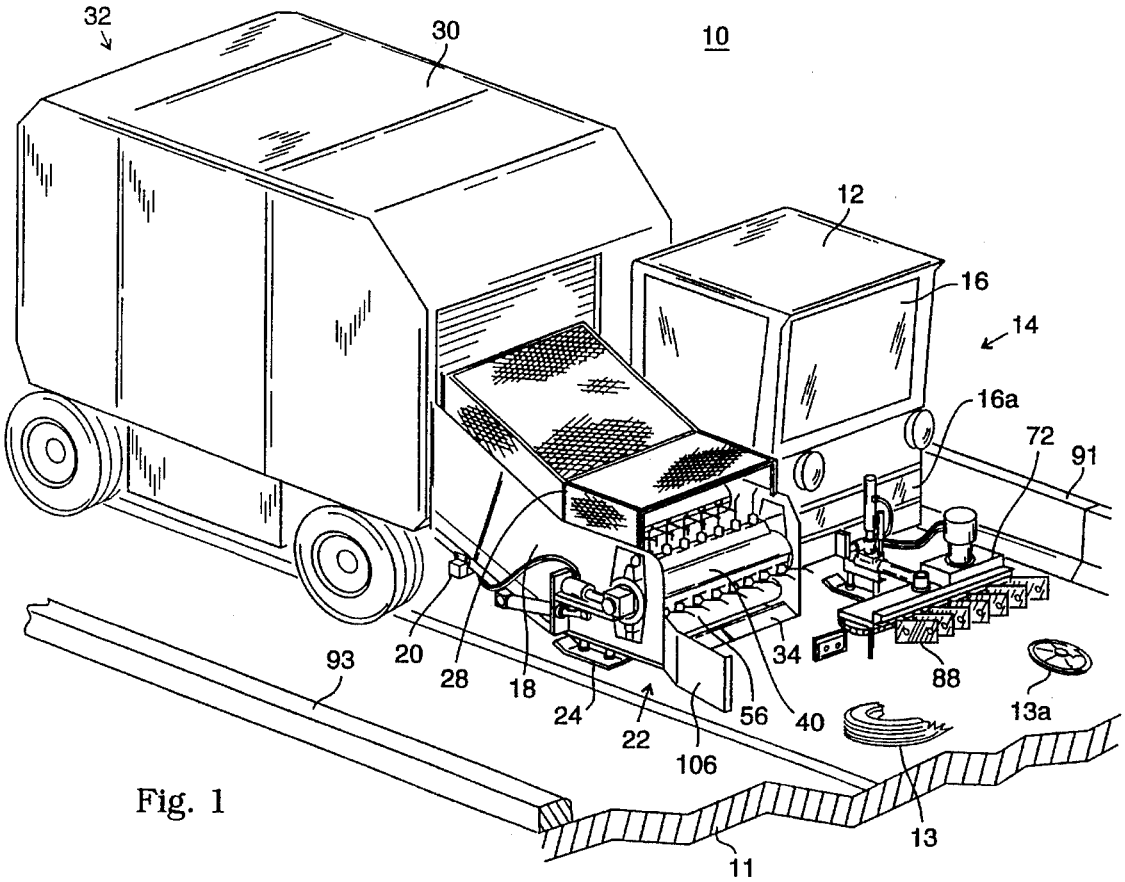
FIG. 1 is a front perspective view of a debris-collecting vehicle according to the present invention.

Referring to FIG. 1, a vehicle 10 according to the present invention is illustrated. Although vehicle 10 is preferably designed to collect large or heavy objects from the surface of a road 11, nothing prevents vehicle 10 from also collecting small or lightweight objects. Vehicle 10 generally includes an operator cab 12, a front section 14, a boom assembly 18, a collection bin 30, a back section 32, a rotary rake 40, a conveyor belt assembly 56, and a paddle guide assembly 72.

Briefly, vehicle 10 collects debris 13 from road 11 when boom assembly 18 is in a lowered position as shown in FIG. 1. Rotary rake 40 brushes against road 11 to guide debris 13 onto conveyor belt assembly 56. Conveyor belt assembly 56 transports debris 13 into collection bin 30, where debris 13 is stored for later disposal. If an object is located in front of operator cab 12, such as debris **13*a*, then paddle guide assembly 72 is utilized to move the object to a location in front of rotary rake 40. Once debris 13*a* is positioned in front of rotary rake 40**, it can be collected as described above.

Operator cab 12 is located at front section 14 of vehicle 10. According to the preferred embodiment, operator cab 12 is a half-cab structure, i.e., operator cab 12 does not extend across the entire width of front section 14. This configuration provides an operator with a substantially unobstructed view of debris 13 while it is being collected. A clear view is desirable so that the operator can determine whether or not vehicle 10 successfully removes debris 13 from road 11. To facilitate a clear view, operator cab 12 preferably includes a plurality of windows 16. Windows 16 are sized and located to provide an adequate view to the operator. For example, operator cab 12 may be substantially surrounded by windows 16 to give the operator a panoramic view. In addition, operator cab 12 may include a window **16*a* located near the bottom of operator cab 12 to provide the driver with a direct view of road 11, paddle guide assembly 72, or other operating components of vehicle 10**.

The half-cab configuration of vehicle 10 allows boom assembly 18 to be located adjacent to operator cab 12. Boom assembly 18 is located proximate front section 14, and is configured to pivot about a pivot axis 20. Boom assembly 18 includes a forward section 22, and provides mounting locations for several of the components described below. Vehicle 10 includes an operator-controlled hydraulic system (not shown) that provides power to raise and lower boom assembly 18. Preferably, the hydraulic system is also configured to drive other moving components of vehicle 10 (described below). Hydraulic power systems and their implementation in heavy machinery and vehicles are well known to those skilled in this art. Therefore, they will not be described in detail herein.

According to one aspect of the preferred embodiment, forward section 22 is raised to allow vehicle 10 to travel at up to highway speed without collecting debris 13. However, when vehicle 10 is operating to collect objects from road 11, forward section 22 is lowered near to road 11. When lowered, forward section 22 is supported by a plurality of runners 24. Although only one runner 24 is shown in FIG. 1, vehicle 10 preferably includes an additional runner located at the opposite side of boom assembly 18. Each of runners 24 may include a road-protecting element (not shown) attached thereto. The road-protecting elements may be formed from replaceable strips of plastic, polyurethane, rubber, or the like.

According to the preferred embodiment, boom assembly 18 includes a safety cage 28 mounted thereto. Safety cage 28 is configured to substantially cover conveyor belt assembly 56 along with other operating components described below. This configuration is desirable to prevent human injury and to prevent debris 13 from escaping before it reaches collection bin 30. To maintain the desired visibility for the operator, safety cage 28 is preferably formed from a metal screen. Of course, other materials may be suitable for safety cage 28.

Collection bin 30 is located at back section 32 of vehicle 10. Collection bin 30 is preferably located behind operator cab 12 so that the operator's view is not obstructed. As described previously, conveyor belt assembly 56 transports debris 13 into collection bin 30, where it falls off of conveyor belt assembly 56 and is stored for later disposal or processing.

Figure 2:
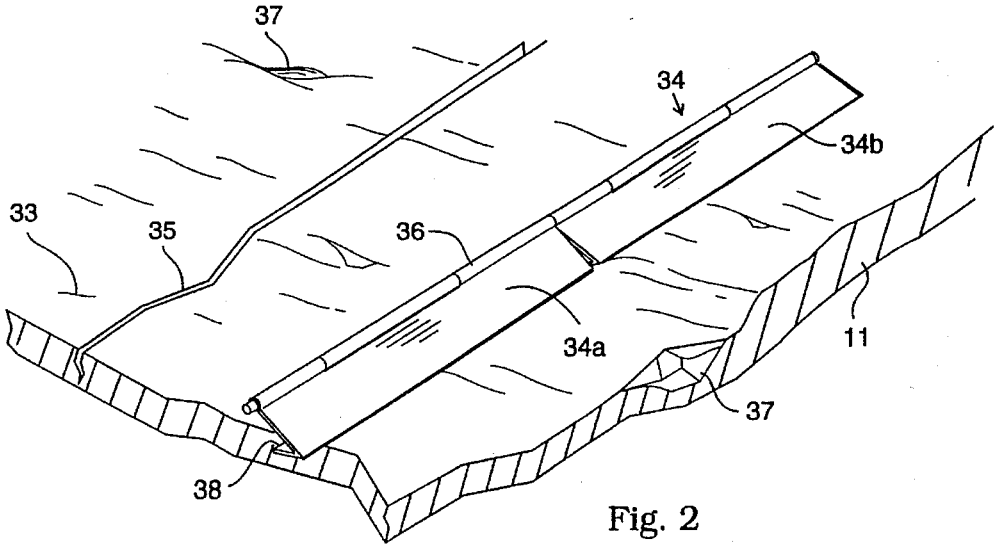
FIG. 2 is a front perspective view of a road and a leader blade according to the present invention.

As described briefly above, vehicle 10 collects debris 13 with forward section 22 of boom assembly 18 lowered to road 11. When forward section 22 is lowered, runners 24 support the bulk of boom assembly 18. In addition, leader blade 34 contacts the road surface. With reference to FIG. 2, leader blade 34 is shown in contact with the surface 33 of road 11. According to the preferred embodiment, leader blade 34 is coupled to forward section 22 via a hinge 36. Hinge 36 may be under tension to urge leader blade 34 onto surface 33 when boom assembly 18 is lowered. Leader blade 34 includes a base plate 38 that projects rearwardly toward back section 32 of vehicle 10. When boom assembly 18 is lowered, base plate 38 is substantially contiguous with surface 33 of road 11. Base plate 38 enables leader blade 34 to pass smoothly over cracks 35 and depressions 37 that may be formed in road 11. In other words, base plate 38 prevents leader blade 34 from getting caught in cracks 35 and depressions 37 as vehicle 10 travels forward on road 11. Thus, imperfections in road 11 preferably do not cause damage to leader blade 34 or road 11 while vehicle 10 collects debris 13.

According to one aspect of the preferred embodiment, leader blade 34 is configured such that it forms a plurality of independent sections 34*a* and 34*b*. This sectional configuration allows leader blade 34 to follow transverse variations in road 11 while vehicle 10 collects debris. Transverse variations in road 11 may cause it to be uneven across its width, as shown in the cross sectional view of road 11 depicted in FIG. 2. Leader blade 34 is preferably configured such that sections 34*a* and 34*b* remain in contact with corresponding sections of surface 33. Those skilled in this art will appreciate that leader blade 34 may include more independent elements if increased road contact is desired.

When vehicle 10 removes an object from a road, rotary rake 40 sweeps the object over leader blade 34 and onto conveyor belt assembly 56. Thus, leader blade 34 acts as a ramp that debris 13 is raked up before it is placed upon conveyor belt assembly 56. Referring now to FIG. 3, boom assembly 18 is shown in an exploded view along with various components that are mounted upon it. As shown, rotary rake 40 is mounted to forward section 22 of boom assembly 18 such that it has a substantially horizontal axis of rotation. According to the preferred embodiment, rotary rake 40 is powered by the central hydraulic system described above in relation to boom assembly 18. Of course, the present invention is not limited to the rotary rake configuration shown, and other equivalent means for transferring debris 13 from road 11 to conveyor belt assembly 56 may be implemented.

According to the preferred embodiment, rotary rake 40 is movably mounted to forward section 22 such that the vertical position of rotary rake 40 varies between an upper limit 41 and a lower limit 43. This allows rotary rake 40 to self-adjust to accommodate unusually large items. The force of gravity causes rotary rake 40 to normally rest near lower limit 43, and rotary rake 40 automatically raises toward upper limit 41 while raking in larger objects. As shown, rotary rake 40 is mounted to a swingarm assembly 44. A first end 46 of swingarm assembly 44 is coupled to boom assembly 18, and a second end 48 of swingarm 44 supports the axis of rotation of rotary rake 40. Although only one side of rotary rake 40 is shown in FIG. 3, a similar swingarm structure may also be mounted on the opposite side of rotary rake 40. Thus, if an unusually large object is to be collected, then rotary rake 40 can swing upward, which allows the object to pass under rotary rake 40.

With reference now to FIG. 4, a flexibly-mounted tine 50 is shown in detail. A plurality of flexibly-mounted tines 50 are preferably mounted to rotary rake 40 and arranged in horizontal rows (see FIG. 3). Each of tines 50 has a mounting base 52 and a rigid rod 54 extending from mounting base 52. The strength and durability of tines 50 is desirably sufficient to allow rotary rake 40 to collect heavy objects. Preferably, mounting base 52 is formed from a flexible and durable material such as rubber. The flexible mounting allows tines 50 to bend upon contact with road 11, which prevents road 11 from being damaged. Tines 50 are also able to conform to small variations in the road surface, which ensures that the debris is raked onto conveyor belt assembly 56. In addition, tines 50 are capable of bending to receive unusually shaped objects.

Referring back to FIG. 3, after rotary rake 40 sweeps debris 13 over leader blade 34, debris 13 rests upon conveyor belt assembly 56. Conveyor belt assembly 56 extends along boom assembly 18 from leader blade 34 to collection bin 30. Conveyor belt assembly 56 preferably rests on a support structure (hidden from view) that allows conveyor belt assembly 56 to carry heavy items. Conveyor belt assembly 56 is also powered by the main hydraulic system utilized for other moving components of vehicle 10.

According to the preferred embodiment, a plurality of cleats 58 are mounted onto the surface of conveyor belt assembly 56. Cleats 58 are configured to retain debris 13 upon conveyor belt assembly 56 while debris 13 is transported into collection bin 30. Cleats 58 provide friction and grip to the surface of conveyor belt assembly 56, which reduces the tendency for gravity to cause debris 13 to fall down conveyor belt assembly 56. In the preferred embodiment, cleats 58 are formed from strips of hard rubber or plastic. It should be appreciated that the precise arrangement and composition of cleats 58 may vary according to the specific application.

Vehicle 10 includes a debris catcher 60, as shown in FIG. 3. Debris catcher 60 is configured to catch debris 13 that slides down conveyor belt assembly 56 after it has been collected. Debris catcher 60 further functions to prevent debris 13 from falling back onto the road, and to protect rotary rake 40 from damage caused by falling objects. Debris catcher 60 desirably prevents debris 13 from sliding down conveyor belt assembly 56 past a predetermined point. Debris catcher 60 is preferably mounted to boom assembly 18, and is positioned above and across conveyor belt assembly 56. According to the preferred embodiment, debris catcher 60 is located at a point approximately one-third of the distance between leader blade 34 and collection bin 30.

Debris catcher 60 includes a plurality of bars 62 attached to a swinging crossbar 64. Bars 62 and swinging crossbar 64 are preferably formed from steel. Swinging crossbar 64 is pivotally mounted to boom assembly 18. Bars 62 extend downward towards the surface of conveyor belt assembly 56, but preferably do not touch its surface. This configuration enables bars 62 to swing freely and allows debris 13 to pass under debris catcher 60. The weight of debris 13 is sufficient to cause bars 62 to swing upward and backward while debris 13 passes under debris catcher 60.

Debris catcher 60 also includes a limiting crossbar 66 that prevents bars 62 from swinging forward toward rotary rake 40. Preferably, limiting crossbar 66 is also formed from steel. Limiting crossbar 66 is mounted across boom assembly 18, and is positioned below crossbar 64. Limiting crossbar 66 is located in front of bars 62, i.e., toward rotary rake 40. According to one aspect of the preferred embodiment, bars 62 are normally resting against and behind limiting crossbar 66, due the weight and configuration of bars 62 and crossbar 64. Thus, the forward travel of bars 62 is blocked by limiting crossbar 66, and debris catcher 60 functions as a one-way gate.

Vehicle 10 also includes a second rotary rake 68. If an object gets caught in rotary rake 40, then second rotary rake 68 removes the object so that it can be properly collected. Second rotary rake 68 is mounted to and approximately spans the width of boom assembly 18. Second rotary rake 68 is also driven by the central hydraulic system of vehicle 10.

Second rotary rake 68 includes a plurality of fingers 70 that are positioned proximate rotary rake 40. As rotary rake 40 and second rotary rake 68 rotate, fingers 70 pass between tines 50. Fingers 70 may even contact tines 50 depending upon the position of tines 50 during collection of debris 13. Fingers 70 are preferably formed from steel and are rigidly mounted to second rotary rake 68 to ensure that objects caught in tines 50 are successfully removed from rotary rake 40. Second rotary rake 68 preferably rotates in the same direction as rotary rake 40 such that the downward motion of fingers 70 opposes the upward motion of tines 50. In other words, second rotary rake 68 rotates such that objects are removed in a downward manner toward conveyor belt assembly 56.

Figure 5:
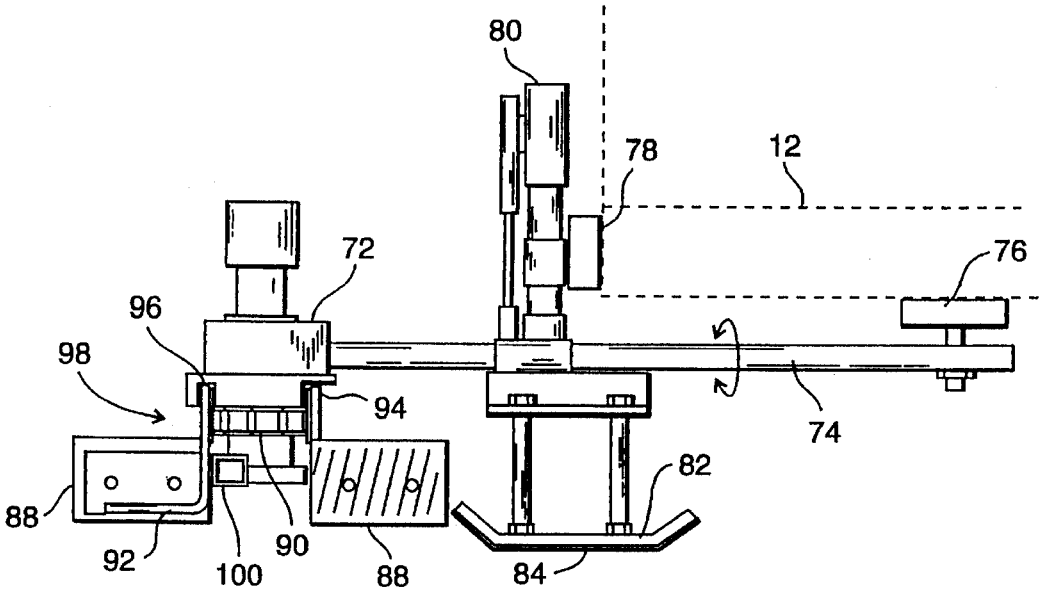
FIG. 5 is a side view of a paddle guide assembly according to the present invention.

With reference now to FIG. 5, paddle guide assembly 72 is illustrated in detail. As described briefly above, paddle guide assembly 72 is utilized to move debris 13 from a remote location on road 11 (generally in front of operator cab 12) to a location proximate rotary rake 40. For example, debris **13*a* (see FIG. 1) will initially be moved toward the right side of vehicle 10 during collection. After debris 13*a* is moved in front of rotary rake 40, it can be collected as described above. Paddle guide assembly 72 is located at front section 14 of vehicle 10, and preferably in front of operator cab 12. As shown in FIG. 1, paddle guide assembly 72 enables vehicle 10 to collect any debris that may be in its path, whether or not it is in front of boom assembly 18. In addition, paddle guide assembly 72 is preferably configured to allow vehicle 10 to collect debris 13 located against a left-side curb 91 (see FIGS. 1 and 6**).

Paddle guide assembly 72 is adjustably mounted to vehicle 10 by a support bar 74. Preferably, support bar 74 is mounted to vehicle 10 at a first bracket 76 underneath operator cab 12 and at a second bracket 78 in front of operator cab 12. Second bracket 78 is coupled to a hydraulic lift 80, which functions to raise and lower paddle guide assembly 72 independently of boom assembly 18. A runner 82 is preferably mounted underneath support bar 74 proximate second bracket 78. Runner 82 supports paddle guide assembly 72 upon road 11 while vehicle 10 collects debris 13. Runner 82 includes a road-protecting element 84 preferably formed from a replaceable strip of plastic, polyurethane, or rubber.

Figure 6:
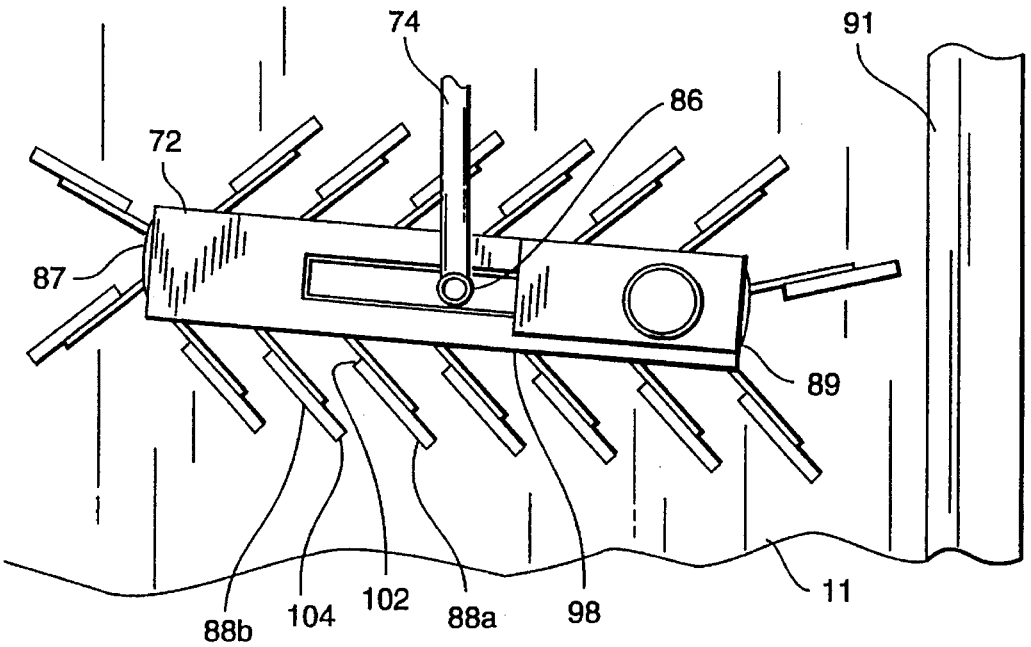
FIG. 6 is a top view of the paddle guide assembly.

With brief reference to FIG. 6, support bar 74 connects to paddle guide assembly 72 at a third mounting bracket 86. Third mounting bracket 86 is preferably configured to allow the angle of paddle guide assembly 72, relative to road 11, to be adjustable. The angle of paddle guide assembly 72 is adjusted by rotating paddle guide assembly 72 about third mounting bracket 86. Thus, if the right end 87 of paddle guide assembly 72 is moved closer to operator cab 12, then the left end 89 will be correspondingly moved further from operator cab 12. Thus, the angle of paddle guide assembly 72, relative to the direction of travel of vehicle 10, may be set such that debris **13*a* can be moved towards rotary rake 40 in an effective manner. FIG. 6 shows paddle guide assembly 72 positioned at an exemplary angle. The transverse position of paddle guide assembly 72 is also variable by adjusting its left/right position relative to support bar 74. Thus, paddle guide assembly 72 may be adjusted to extend beyond the left side of vehicle 10 such that vehicle 10 can collect objects that are located against left-side curb 91. According to the preferred embodiment, the angular and left/right positions of paddle guide assembly 72 are fixed while vehicle 10** is in use.

According to one aspect of the present invention, support bar 74 rotates about its longitudinal axis (as indicated by the arrow in FIG. 5). This enables paddle guide assembly 72 to substantially follow transverse variations in road 11 during the collection of debris 13. Such road variations were described above in connection with FIG. 2. In addition, if surface 33 of road 11 transitions upwards to a median, a retaining wall, or left-side curb 91, paddle guide assembly 72 is capable of following the contour of road 11. The "rocking" motion of paddle guide assembly 72 occurs automatically (without operator involvement) in response to variations in road 11.

Referring to FIGS. 5–6, a plurality of paddles 88 are coupled to a drive chain 90, which revolves around paddle guide assembly 72. Again, the main hydraulic system of vehicle 10 supplies the operating power for drive chain 90. Each of paddles 88 is attached to an L-shaped mounting bracket 92, which is coupled to drive chain 90. Mounting bracket 92 terminates at a locating tip 94, which extends above the height of paddle 88. According to the preferred embodiment, paddle guide assembly 72 includes a track 96 configured to receive locating tip 94. Track 96 is located at a leading face 98 of paddle guide assembly 72. Paddle guide assembly 72 also includes a support element 100, which is located at leading face 98. Support element 100 is adapted to be positioned near the bottom of mounting bracket 92. Track 96 and support element 100 are configured to maintain a portion of paddles 88 (those located at leading face 98) perpendicular to the road during the collection of debris 13. The added support prevents paddles 88 from folding or buckling under paddle guide assembly 72 during use.

Paddles 88 are preferably rigid enough to allow paddle guide assembly 72 to move heavy objects toward rotary rake 40. Each of paddles 88 may also include a flexible tip or a brush element (not shown) to allow paddles 88 to contact structures, such as left-side curb 91, without breaking.

As best shown in FIG. 6, paddles 88 are desirably positioned in an overlapping angular configuration along leading face 98. As shown, an inner edge 102 of a first paddle 88*a* is positioned behind an outer edge 104 of a second paddle 88*b*. Second paddle 88*b* is adjacent to and ahead of first paddle 88*a* relative to the motion of paddles 88 around paddle guide assembly 72. This arrangement is desirable to prevent debris from passing between or becoming entangled in paddles 88. When located along leading face 98, paddles 88 are arranged to point outward from paddle guide assembly 72 and toward left end 89 of paddle guide assembly 72. The angled configuration enables paddles 88 to effectively move an object to a location near rotary rake 40.

To prevent paddles 88 from propelling debris 13 beyond rotary rake 40, vehicle 10 is equipped with a retaining shield 106 (see FIGS. 1 and 3). Retaining shield 106 is mounted to forward section 22 of boom assembly 18, near the right side of vehicle 10. Retaining shield 106 is adjacent to rotary rake 40, and it protrudes forward beyond forward section 22 and preferably beyond the location of paddle guide assembly 72. In accordance with the preferred embodiment, retaining shield 106 may also be configured to extend slightly to the right of rotary rake 40. The extended width of retaining shield 106 allows the preferred embodiment of vehicle 10 to gather debris 13 located against a right-side curb 93 (see FIG. 1) or other structures. Thus, retaining shield 106 reduces the likelihood of vehicle 10 missing an object.

In summary, the present invention provides an improved vehicle for removing large or heavy debris, as well as smaller objects, from a road. The vehicle is configured to give an operator an unobstructed view of the debris while it is being collected. A debris-collecting vehicle according to the present invention is capable of removing debris from a road having surface variations across the width of the road. In addition, the vehicle is capable of removing debris located against a curb or a retaining structure on a road.

The above description is of a preferred embodiment of the present invention, and the invention is not limited to the specific embodiment described and illustrated. For example, descriptors such as "above," "below," "front," "left," "right," and the like, have been used in a relative sense to maintain consistency with the Figures. In addition, the configuration and composition of the various components may vary according to specific requirements. Furthermore, many variations and modifications will be evident to those skilled in this art, and such variations and modifications are intended to be included within the spirit and scope of the invention, as expressed in the following claims.

What is claimed is:

1. A vehicle for collecting debris from a road, said vehicle comprising:

a front section;

a back section;

an operator cab located proximate said front section;

a collection bin located proximate said back section;

a conveyor belt assembly located adjacent to said operator cab, said conveyor belt assembly being configured to transport said debris to said collection bin;

means for transferring said debris from said road to said conveyor belt assembly, said means for transferring being located proximate said front section;

a guide assembly located proximate said front section;

a drive chain configured to revolve around said guide assembly; and a plurality of relocation elements coupled to said drive chain, said plurality of relocation elements being adapted to relocate said debris from a remote location on said road to a location on said road proximate said means for transferring; wherein said operator cab, said conveyor belt assembly, and said means for transferring are configured to allow an operator to view collection of said debris at said means for transferring.

2. A vehicle for collecting debris according to claim 1, further comprising a retaining shield, wherein:

said retaining shield is located adjacent to said means for transferring; and said retaining shield prevents said plurality of relocation elements from propelling said debris beyond said means for transferring while said vehicle collects said debris.

3. A vehicle for collecting debris according to claim 1, wherein said means for transferring comprises a rotary rake having a plurality of tines.

4. A vehicle for collecting debris according to claim 1, wherein said plurality of relocation elements are configured as a plurality of substantially rigid paddles.

5. A vehicle for collecting debris according to claim 4, wherein:

said guide assembly includes a leading face; and said paddles, when positioned along said leading face, are arranged in an overlapping angular configuration relative to said leading face.

6. A vehicle for collecting debris according to claim 5, wherein:

each of said paddles is coupled to said drive chain by a mounting bracket having a locating tip;

said guide assembly comprises a track, located proximate said leading face, for receiving said locating tip and a supporting element, located proximate said leading face, for supporting said mounting bracket; and said track and said supporting element are configured to maintain said paddles substantially perpendicular to said road while said vehicle collects said debris.

7. A vehicle for collecting debris according to claim 4, wherein said guide assembly pivots to allow said guide assembly to substantially follow transverse variations in said road while said vehicle collects said debris.

8. A vehicle for collecting debris according to claim 1, further comprising a leader blade located proximate said means for transferring.

9. A vehicle for collecting debris according to claim 8, wherein said leader blade includes a base plate that projects rearwardly toward said back section and is adapted to be substantially contiguous with said road while said vehicle collects said debris.

10. A vehicle for collecting debris according to claim 8, wherein said leader blade has a plurality of independent sections that permit said leader blade to substantially follow transverse variations in said road while said vehicle collects said debris.

11. A vehicle for collecting debris from a road comprising:

a front section;

a back section;

a collection bin located proximate said back section;

a boom assembly located proximate said front section, said boom assembly having a forward section;

a conveyor belt assembly mounted on said boom assembly, said conveyor belt assembly being configured to transport said debris to said collection bin;

means for catching debris, said means for catching being mounted to said boom assembly and configured to prevent a portion of said debris from sliding down said conveyor belt assembly past a predetermined point; and means for transferring said debris from said road to said conveyor belt assembly, said means for transferring being mounted proximate said forward section of said boom assembly; wherein said forward section of said boom assembly is raised to allow said vehicle to travel without collecting said debris and lowered while said vehicle collects said debris.

12. A vehicle for collecting debris according to claim 11, further comprising a safety cage mounted on said boom assembly, said safety cage being configured to substantially cover said conveyor belt assembly.

13. A vehicle for collecting debris according to claim 11, wherein said conveyor belt assembly includes a plurality of cleats configured to retain said debris upon said conveyor belt assembly while said conveyor belt assembly transports said debris to said collection bin.

14. A vehicle for collecting debris according to claim 11, further comprising a leader blade coupled to said forward section of said boom assembly.

15. A vehicle for collecting debris according to claim 14, wherein said leader blade has a plurality of independent sections that permit said leader blade to substantially follow transverse variations in said road while said vehicle collects said debris.

16. A vehicle for collecting debris according to claim 14, wherein said leader blade includes a base plate that projects rearwardly toward said back section and is adapted to be substantially contiguous with said road while said vehicle collects said debris.

17. A vehicle for collecting debris according to claim 11, further comprising means for relocating said debris, wherein:

said means for relocating is located proximate said front section; and said means for relocating moves said debris from a remote location on said road to a location on said road proximate said means for transferring.

18. A vehicle for collecting debris according to claim 17, wherein said means for relocating comprises:

a paddle guide assembly;

a drive chain configured to revolve around said paddle guide assembly; and a plurality of paddles coupled to said drive chain.

19. A vehicle for collecting debris according to claim 11, wherein said means for catching comprises:

a swinging crossbar pivotally coupled across said boom assembly and located above said conveyor belt assembly;

a plurality of bars attached to said swinging crossbar, said plurality of bars being configured to extend downwardly toward said conveyor belt assembly; and a limiting crossbar mounted below said swinging crossbar and across said boom assembly, said limiting crossbar being configured to prevent said plurality of bars from swinging past a predetermined point.

20. A vehicle for collecting debris from a road comprising:

a front section;

a back section;

a collection bin located proximate said back section;

a boom assembly located proximate said front section, said boom assembly having a forward section;

a conveyor belt assembly mounted on said boom assembly, said conveyor belt assembly being configured to transport said debris to said collection bin; and a rotary rake coupled to said boom assembly proximate said forward section and configured to rotate about a substantially horizontal axis to transfer said debris from said road to said conveyor belt assembly, said rotary rake being movably mounted such that the vertical position of said axis is variable relative to said boom assembly; wherein said forward section of said boom assembly is raised to allow said vehicle to travel without collecting said debris and lowered while said vehicle collects said debris.

21. A vehicle for collecting debris according to claim 20, further comprising means for removing said debris from said rotary rake.

22. A vehicle for collecting debris according to claim 21, wherein said means for removing comprises a second rotary rake having a plurality of fingers that are positioned proximate said rotary rake.

23. A vehicle for collecting debris according to claim 20, wherein said rotary rake comprises a plurality of flexibly-mounted tines.

* * * * *